US007760154B2

(12) United States Patent
Sekine et al.

(10) Patent No.: US 7,760,154 B2
(45) Date of Patent: Jul. 20, 2010

(54) ANTENNA APPARATUS

(75) Inventors: Shuichi Sekine, Tokyo (JP); Kazuhiro Inoue, Tokyo (JP); Makoto Higaki, Kawasaki (JP); Yukako Tsutsumi, Yokohama (JP); Akihiro Tsujimura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/170,733

(22) Filed: Jul. 10, 2008

(65) Prior Publication Data

US 2009/0040112 A1 Feb. 12, 2009

(30) Foreign Application Priority Data

Aug. 9, 2007 (JP) ..... 2007-208383

(51) Int. Cl.
*H01Q 9/16* (2006.01)
*H01Q 15/02* (2006.01)
*H01Q 19/10* (2006.01)

(52) U.S. Cl. ..... 343/795; 343/846; 343/909

(58) Field of Classification Search ..... 343/700 MS, 343/846, 795, 909

See application file for complete search history.

(56) References Cited

U.S. PATENT DOCUMENTS 6,768,476 B2 * 7/2004 Lilly et al. ..... 343/909
2003/0197658 A1 10/2003 Lilly et al.
2008/0150825 A1 6/2008 Higaki et al.

FOREIGN PATENT DOCUMENTS

EP 1 939 982 A1 7/2008
JP 2005-94360 4/2005
JP 2005-110273 4/2005

OTHER PUBLICATIONS

U.S. Appl. No. 12/410,768, filed Mar. 25, 2009, Suetsuna, et al.
U.S. Appl. No. 12/188,522, filed Aug. 8, 2008, Inoue, et al.
Fan Yang, et al., "Reflection Phase Characterizations of the EBG Ground Plane for Low Profile Wire Antenna Applications", IEEE Transactions on Antennas and Propagation, IEEE Service Center, Piscataway, NJ, US, vol. 51, No. 10, part 01, Oct. 1, 2003, pp. 2691-2703, XP01175159.

(Continued)

*Primary Examiner*—Michael C Wimer
(74) *Attorney, Agent, or Firm*—Oblon, Spivak, McClelland, Maier & Neustadt, L.L.P.

(57) ABSTRACT

There is provided with an antenna apparatus, including:
a finite ground plate; a plurality of conductor plates arranged along and on both sides of a first gap line or a second gap line that intersect with the first gap line; a plurality of first linear conductive elements configured to connect the finite ground plate with each of the conductor plates; and an antenna element configured to have second and third linear conductive elements arranged in the first gap line and a feeding point that is placed between adjacent ends of the second and third linear conductive elements for supplying electric power from the ends, wherein the feeding point is positioned in an intersection area of the first gap line and the second gap line.

8 Claims, 8 Drawing Sheets

OTHER PUBLICATIONS

Fan Yang, et al., "Bent Monopole Antennas on EBG Ground Plane with Reconfigurable Radiation Patterns", Antennas and Propagation Society, Symposium, 2004, IEEE Monterey, CA, USA Jun. 20-25, 2004, Piscataway, NJ, USA, IEEE, vol. 2, Jun. 20, 2004, pp. 1819-1822, XP010721708.

Jodie M. Bell, et al., " A Low-Profile Archimedean Spiral Antenna Using an EBG Ground Plane", IEEE Antennas and Wireless Propagation Letters, IEEE, Piscataway, NJ, US, vol. 3, No. 1, Dec. 1, 2004, pp. 223-226, XP011183017.

U.S. Appl. No. 12/623,749, Nov. 23, 2009, Inoue, et al.

* cited by examiner

ANTENNA APPARATUS

CROSS REFERENCE TO RELATED APPLICATIONS

This application is based upon and claims the benefit of priority from the prior Japanese Patent Applications No. 2007-208383, filed on Aug. 9, 2007; the entire contents of which are incorporated herein by reference.

BACKGROUND OF THE INVENTION

1. Field of the Invention

The present invention relates to an antenna apparatus for a small and thin wireless device, and more particularly, to a technique for implementing an antenna on a high-impedance substrate.

2. Related Art

An Electromagnetic Band Gap (EBG) substrate is known as a technique for arranging a metallic plate (a ground plate) and an antenna in proximity to each other for the purpose of making an antenna apparatus thin. An EBG substrate is structured by arranging conductor plates in a matrix at a certain height on a metallic plate and each of the conductor plates is connected with the metallic plate by a linear conductive element. The EBG substrate realizes high impedance by creating LC parallel resonance circuits by way of distributed constant circuits so as to suppress unnecessary current distribution generated on the metallic plate.

However, since a current distributes also on the EBG substrate, degradation of antenna characteristics occurs when the EBG substrate and the antenna are arranged very closely to each other. This is because current distribution on the antenna significantly varies due to the effect of current distributing on the EBG substrate, which makes matching impossible. A steep change of current in the vicinity of a feeding point in particular causes a significant degradation of matching characteristics.

Therefore, EBG substrates generally suppress characteristic variation resulting from mutual coupling by not positioning the antenna and the EBG substrate very closely to each other. Such a method has a limit on reduction of the thickness of an antenna apparatus.

JP-A 2005-110273 (Kokai) describes a method which removes one unit cell of an EBG substrate and places an antenna therein. However, such a placement as described in the publication becomes a cause of hindering the reduction of antenna thickness, which is a goal primarily pursued by the EBG substrate. Also, when the size of unit cells of the EBG substrate is relatively large, an unnecessary current induced by a current on the antenna is generated on the EBG substrate.

U.S. Pat. No. 6,768,476 discloses a method for arranging antennas in gaps between conductor plates, which are considered to be little affected by current on the EBG substrate. However, this technique also has a problem that current distribution changes due to influence of current on the EBG substrate and impedance matching characteristic of antennas significantly degrades.

SUMMARY OF THE INVENTION

According to an aspect of the present invention, there is provided with an antenna apparatus, comprising:

a finite ground plate;

a plurality of conductor plates arranged along and on both sides of a first gap line or a second gap line that intersect with the first gap line;

a plurality of first linear conductive elements configured to connect the finite ground plate with each of the conductor plates; and an antenna element configured to have second and third linear conductive elements arranged in the first gap line and a feeding point that is placed between adjacent ends of the second and third linear conductive elements for supplying electric power from the ends, wherein the feeding point is positioned in an intersection area of the first gap line and the second gap line.

DETAILED DESCRIPTION OF THE INVENTION

First, an antenna apparatus using an EBG (Electromagnetic Band Gap) substrate which the present inventors had known before making the present invention is described.

Figure 6:
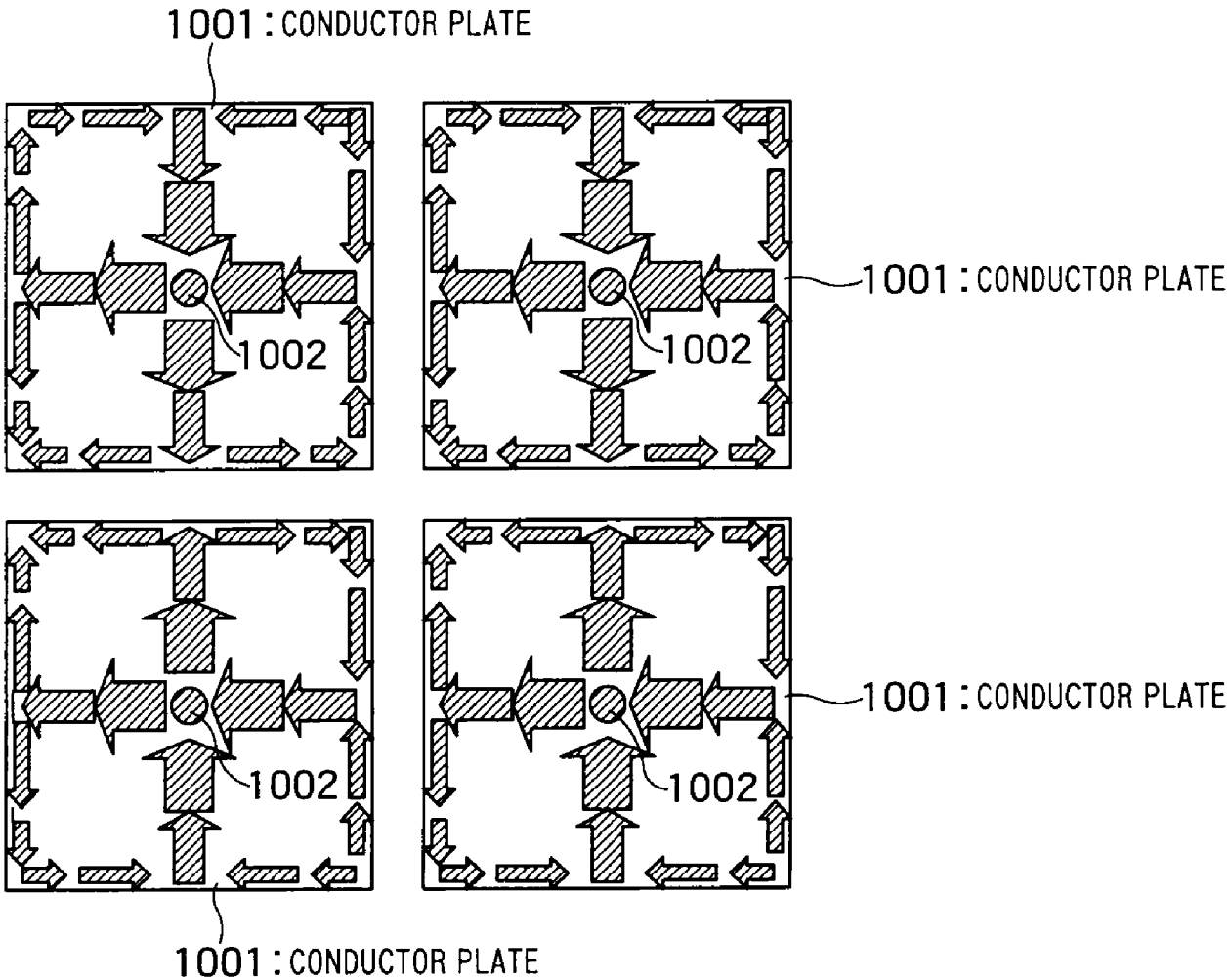
FIG. 6 illustrates current distribution on each conductor plate on an EBG substrate.

FIG. 6 shows current distribution on conductor plates 1001 on an EBG substrate which has a number of conductor plates 1001 arranged in an n×m matrix on a ground plate (not shown). The conductor plates 1001 are each connected to the ground plate by a linear conductive element 1002 at their center. For the brevity of description, attention is focused here on only four conductor plates 1001 out of the conductor plates 1001 arranged in the n×m matrix. As illustrated by the current distribution on the conductor plates 1001 shown in the figure, on each one of the conductor plates 1001 making up the EBG substrate, two currents that have opposite phases to each other flow toward the center of sides along the sides of the conductor plate 1001 when in operation. In the center of the conductor plate 1001, a relatively strong current flows.

Figure 7:
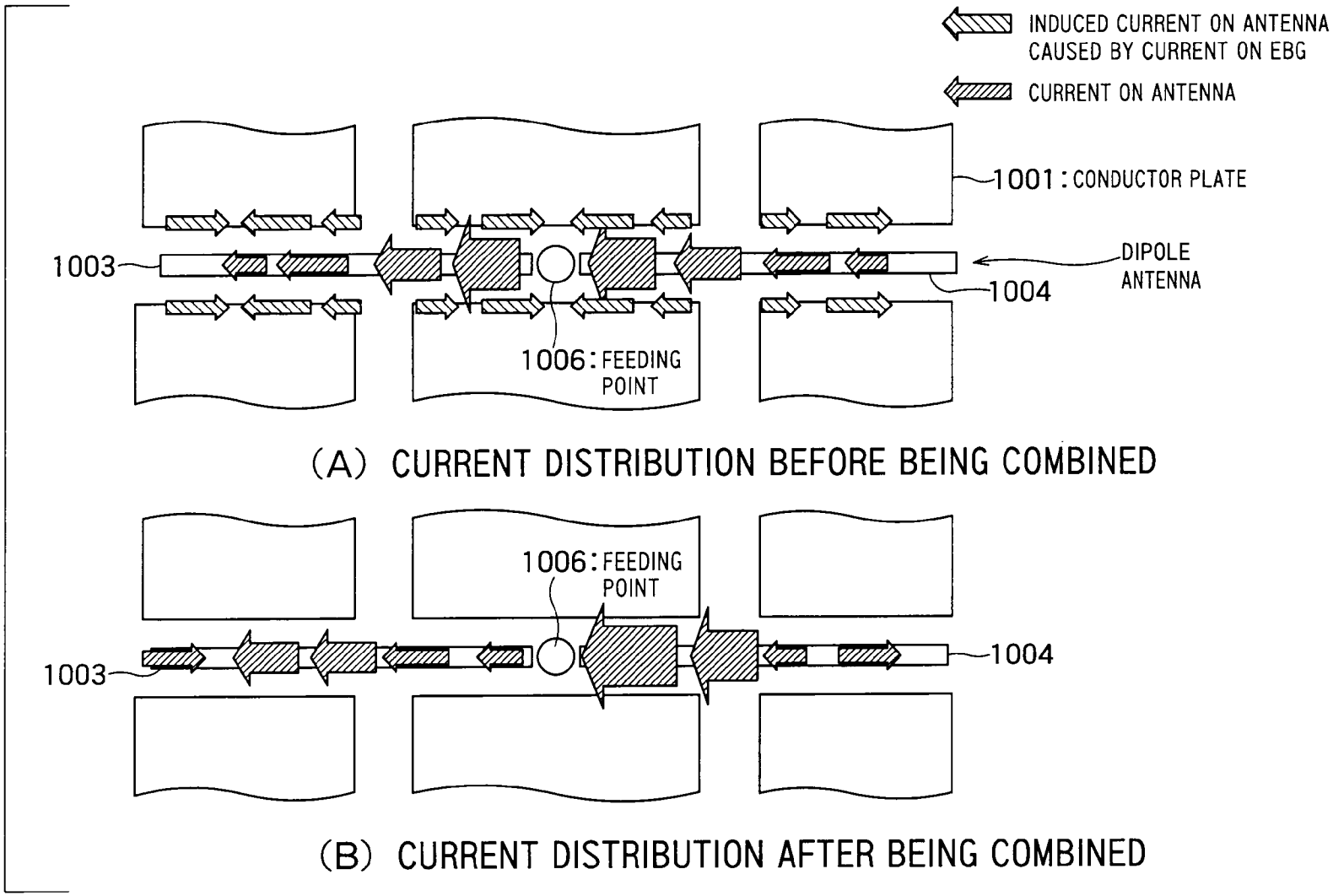
FIG. 7 illustrates current distribution on a dipole antenna mounted in an antenna apparatus prior to making of the present invention.
Figure 8:
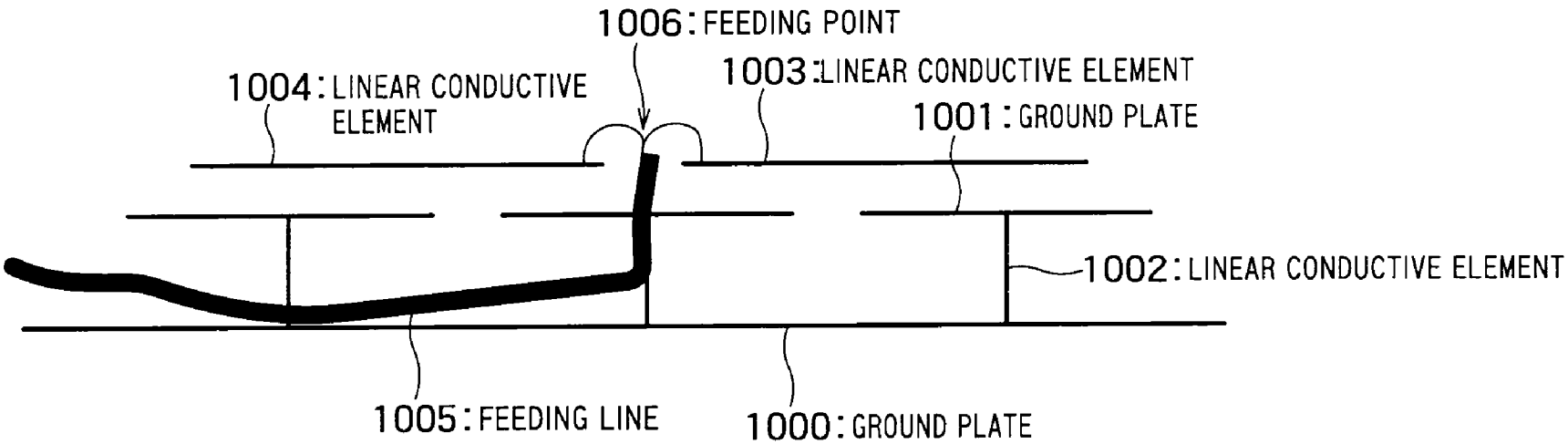
FIG. 8 is a side view of the antenna apparatus of FIG. 7.

FIG. 7 shows current distribution in a dipole antenna in an antenna apparatus with dipole antennas arranged on the EBG substrate. FIG. 8 is a side view of the antenna apparatus. The dipole antenna includes linear conductive elements 1003, 1004, and a feeding point 1006. This dipole antenna is placed in a gap line between conductor plate sequences, and the feeding point 1006 is positioned at about the center of the side of the conductor plate 1001. To the feeding point 1006, a high-frequency current is supplied from a feeder line 1005 as shown in FIG. 8. The conductor plates 1001 are arranged in a matrix on the ground plate 1000. The current distribution shown in FIG. 7(A) separately illustrates distribution of an induced current that is generated on the dipole antenna due to the current on the EBG substrate (i.e., a current that flows on the conductor plate) and distribution of a current that originally exists on the dipole antenna. The current distribution shown in FIG. 7(B) shows distribution of a current that actually flows in the dipole antenna which is the sum of those currents (a combined current).

It can be seen from comparison of FIGS. 7(A) with 7(B), the combined current on the dipole antenna has relatively largely changed from the originally existing current due to the effect of the current on the EBG substrate (currents on the conductor plates). This is because while the current on the dipole antenna is either positive or negative, the current on the EBG substrate undergoes repeated reversal of positive and negative. For transmission or reception of correct waveform signals, current distribution at the feeding point 1006 is very important.

Change of antenna characteristics due to such current on the EBG substrate is not a problem when an interval "a" of conductor plates (or the arrangement pitch of conductor plates) on the EBG substrate is very small compared to wavelength "λ", i.e., "a"<<"λ", and poses a larger problem as the interval "a" becomes closer to the size of the wavelength "λ". This is because when "a"<<"λ", the interval of positive and negative reversal in the current distribution on the EBG substrate described above is small, thus it is possible to consider that currents reversing on the antenna cancel each other.

The embodiments of the present invention are intended to realize an antenna apparatus that enables reduction of thickness by bringing the antenna close to the EBG substrate even when the interval "a" is large to such an extent that it is not possible to consider currents cancel each other on the antenna. Hereinafter, the embodiments are described in detail with reference to drawings.

First Embodiment

Figure 1:
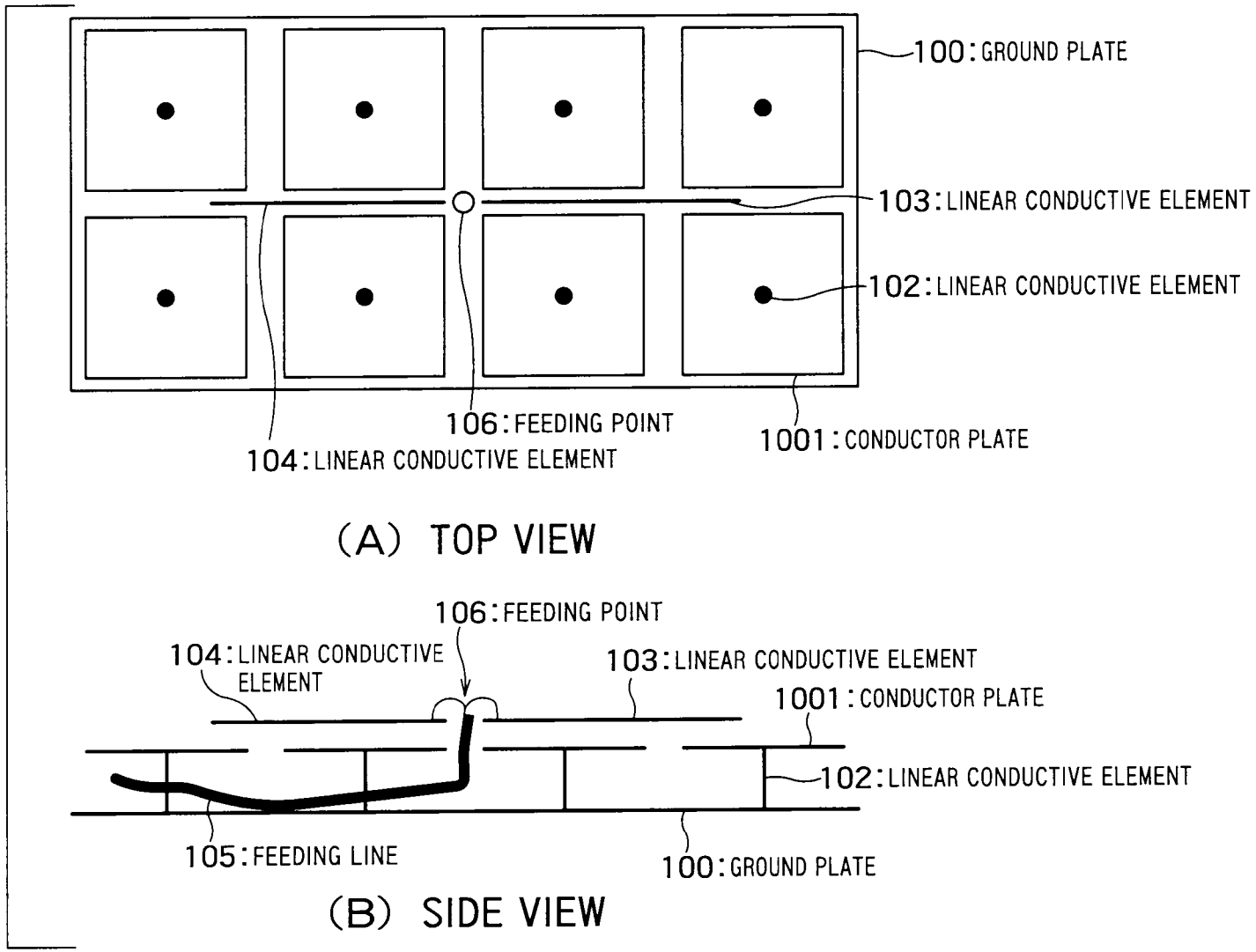
FIG. 1 shows a configuration of an antenna apparatus as a first embodiment of the present invention.

FIG. 1 shows a configuration of an antenna apparatus as a first embodiment of the invention. FIG. 1(A) is a top view and FIG. 1(B) is a side view of the antenna apparatus.

At a certain height from a finite ground plate (or a ground plate) 100, plate conductive elements (conductor plates) 101 are arranged in a matrix with two rows and four columns. The matrix is not limited to having two rows and four columns and may have "n" rows and "m" columns, where "n" and "m" are integers greater than one. The surface of each conductor plate 1001 is approximately parallel with the ground plate 100. Each conductor plate 1001 is connected at its center with the ground plate 100 by the linear conductive element 102. The position at which the conductor plate 1001 is connected to the linear conductive element 102 does not have to be the center of the conductor plate 1001 but may be an arbitrary position as appropriate for desired communication characteristics. The ground plate 100, the matrix-like conductor plates 1001, and the linear conductive elements 102 on the conductor plates form an EBG (Electromagnetic Band Gap) substrate.

The length "h" of the linear conductive element 102 is very small compared to the wavelength "λ" ("h"<<"λ"). Due to combination of stray capacitance between neighboring conductor plates 1001 and stray inductance of the linear conductive element 102, parallel resonance circuits are periodically arranged on the EBG substrate, which makes the entire ground plate have a high impedance.

The length of each side of the conductor plate 1001 is adjusted so that the sum of the side length of the conductor plate 1001 and the length of the linear conductive element 102 is approximately a quarter wavelength. This length of a quarter wavelength means an electrical length and varies with a medium placed in the vicinity of the conductor plate and/or the distance between the conductor plates 1001.

On such an EBG substrate, dipole antennas including the linear conductive elements 103, 104 and the feeding point 106 are arranged. More specifically, the linear conductive elements 103 and 104 are arranged in proximity to each other in a straight line within a first gap line that is formed between conductor plate sequences arranged in a first direction (the horizontal direction in the figure), and the feeding point 106 is placed between adjacent ends of the linear conductive elements 103 and 104 for supplying electric power to those ends. The feeding point 106 is positioned in the intersection area of a second gap line formed between conductor plate sequences that are arranged in a second direction that is approximately orthogonal to the first direction (the vertical direction in the figure) and the first gap line. Strictly speaking, the feeding point 106 is positioned somewhat off the center of the intersection area or the center line of the second gap line, and it has been proved through simulation by the inventors that such a positioning provides better impedance characteristics. The length of the dipole antenna is approximately a half wavelength and the dipole antenna is positioned at a height the same as the conductor plate 1001 or slightly higher than the conductor plate 1001. A feeder line 105 is connected to the feeding point 106 and a high-frequency current from a radio unit not shown is supplied to the feeding point 106 via the feeder line 105.

Figure 2:
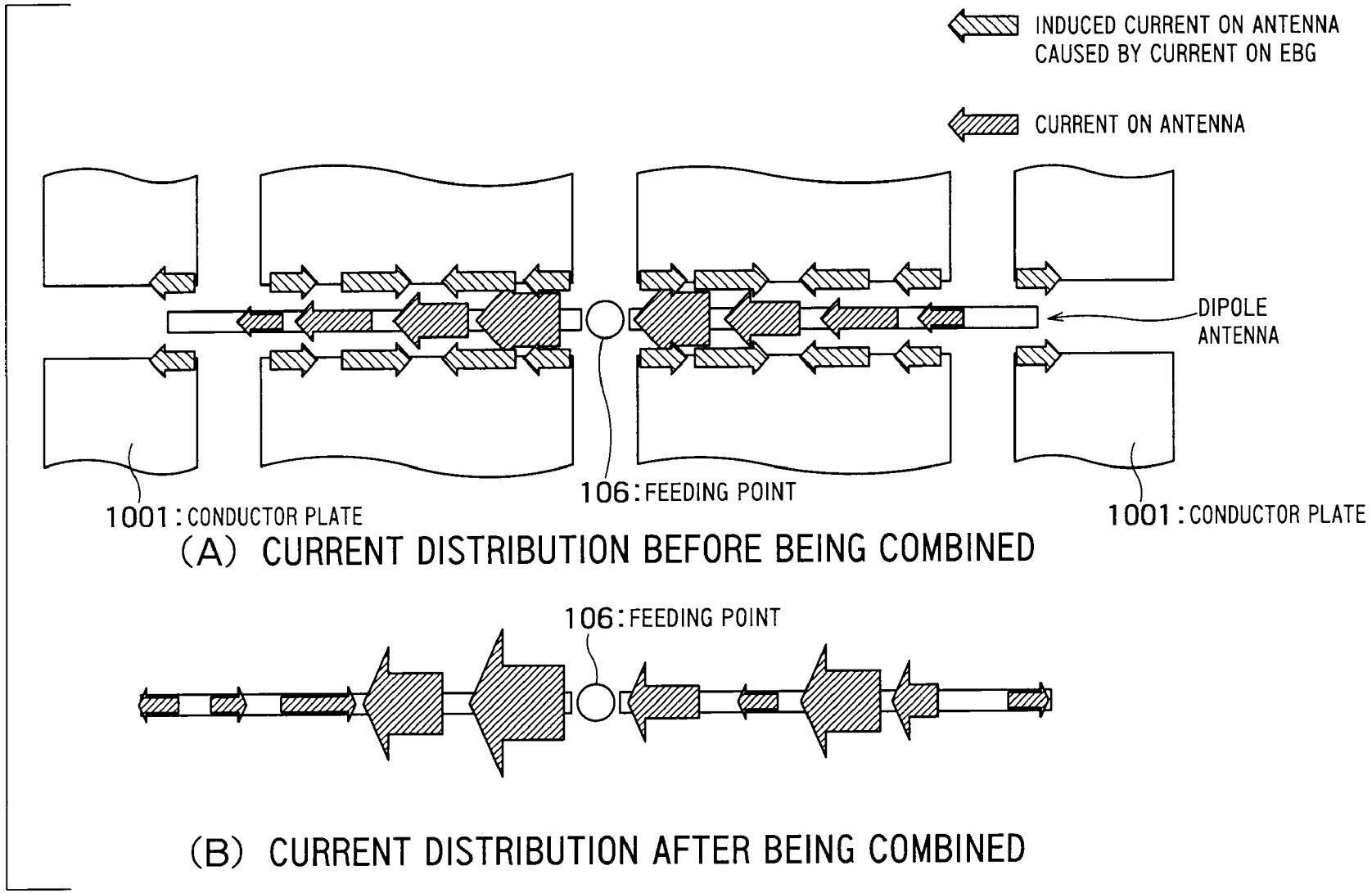
FIG. 2 illustrates current distribution on a dipole antenna of FIG. 1.

FIG. 2 illustrates current distribution on the dipole antenna of FIG. 1. FIG. 2(A) shows an induced current that is generated on the dipole antenna due to a current generated on the EBG substrate and a current that originally exists on the dipole antenna. FIG. 2(B) shows a combined current as the sum of those currents (i.e., current that actually flows on the dipole antenna).

As will be apparent from comparison with the example shown in FIG. 7, in the example of FIG. 2, the difference between the current on the linear conductive elements 102, 103 (i.e., the combined current) and the current that originally exists on the linear conductive elements 102 and 103 is small in the vicinity of the feeding point 106. This reason is as follows.

The current on the EBG substrate assumes a sinusoidal distribution on one conductor plate 1001 from one of its vertices (or corners) to the neighboring vertex via a point of connection with the linear conductive element 102. Therefore, the current is largest at the point where the conductor plate 1001 is connected with the linear conductive element 102 and is smallest at each vertex (see FIG. 6). Accordingly, when the feeding point 106 is placed at an intersection at which vertices of conductor plates 1001 meet (i.e., the intersection area of the first gap line and the second gap line), an induced current that is generated at the feeding point 106 due to the current on the conductor plate 1001 becomes small, which reduces change of current at the feeding point 106 (discontinuity of current distribution at the feeding point 106). Consequently, the current at the feeding point on the dipole antenna becomes close to what it is before the antenna is brought close to the EBG substrate (a state in which the dipole antenna is widely separated from the EBG substrate), which facilitates impedance matching.

In this manner, proximity of the dipole antenna and the EBG substrate is enabled and consequently the antenna apparatus can be made thin. Of course, the EBG substrate including the conductor plates 1001 arranged in a matrix on the ground plate 100 and the linear conductive elements 102 connecting the conductor plates 1001 with the ground plate 100 does not eliminate the effects of suppressing image current generated on the ground plate 100 and consequently improving antenna gain and facilitating impedance matching. These effects can be obtained just as before application of the present invention. Change of current on the antenna caused by the current on the EBG substrate presents a problem especially when the conductor plate is relatively large and has a size of approximately one severalth of a wavelength, but the antenna apparatus of this embodiment can realize both reduction of thickness and excellent impedance characteristics even when such a large conductor plate is used. The maximum length of a side of the conductor plate is in principle approximately λ/4 when the operating wavelength is "λ". Even in such a case, this embodiment can provide excellent effects.

Second Embodiment

Figure 3:
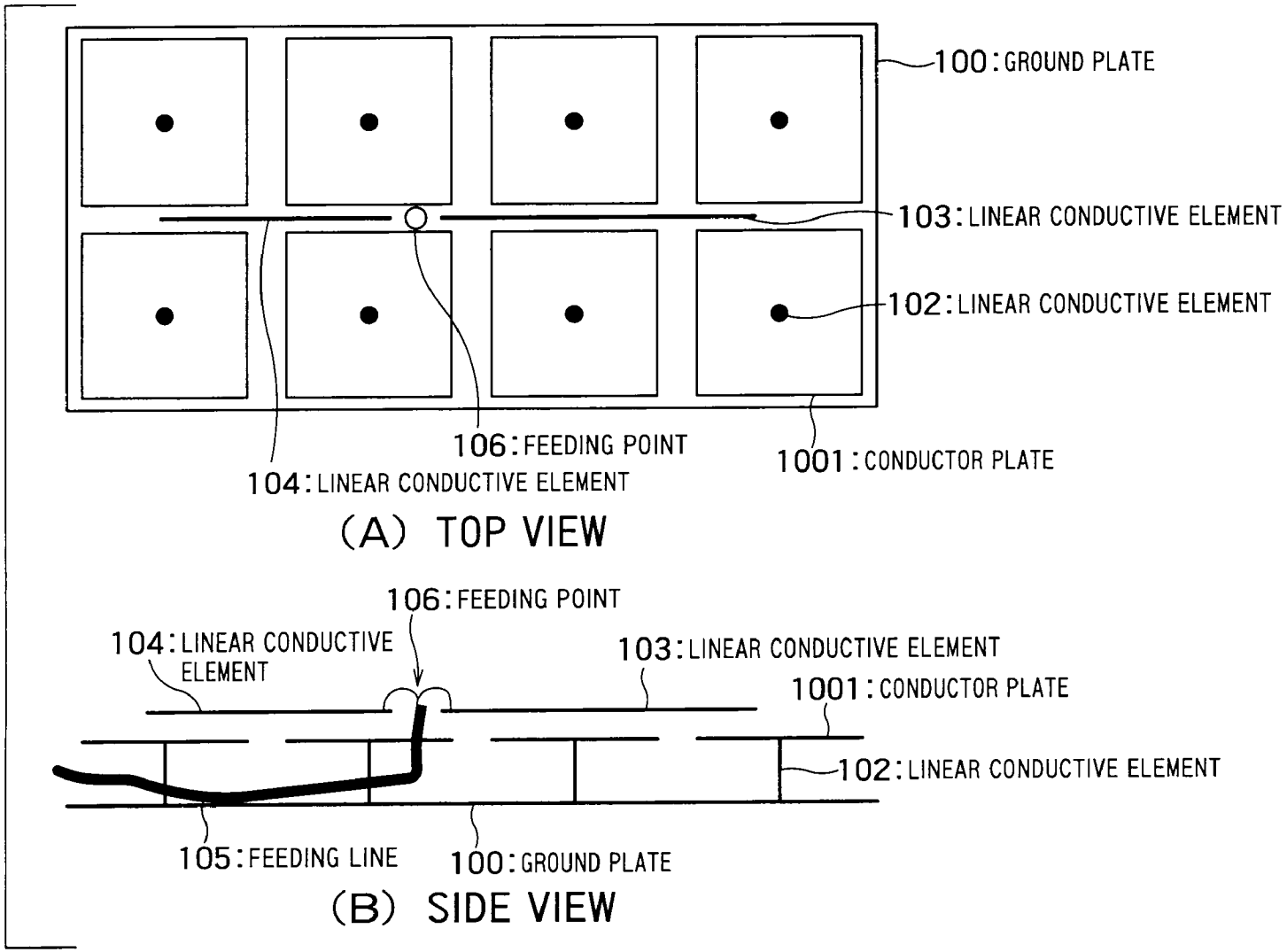
FIG. 3 shows a configuration of an antenna apparatus as a second embodiment of the present invention.

FIG. 3 shows a configuration of an antenna apparatus as a second embodiment of the present invention. FIG. 3(A) is a top view and 3(B) is a side view of the antenna apparatus.

In this antenna apparatus, a feeding point 106 of a dipole antenna is offset along a first gap line (a horizontal line in the figure) from the center of an intersection area of gap lines by a distance "L" which is equal to or smaller than one fourth of the side of a conductor plate. Alternatively, the feeding point 106 is placed in the first gap line at a distance "L" from the center line of a second gap line. As other elements are similar to the first embodiment, like elements are denoted with the same reference numerals and detailed descriptions of them are omitted.

Thus, by placing the feeding point 106 at a position separated by the distance "L" from the center of the intersection area or the center line of the second gap line, the phases of induced currents from the EBG substrate which are added to the vicinity of the feeding point 106 of the dipole antenna are aligned in the same direction. This can further reduce the change of current in the vicinity of the feeding point 106 on the dipole antenna. As a result, discontinuity of current at the feeding point 106 becomes small and impedance matching of the antenna is facilitated.

Figure 4:
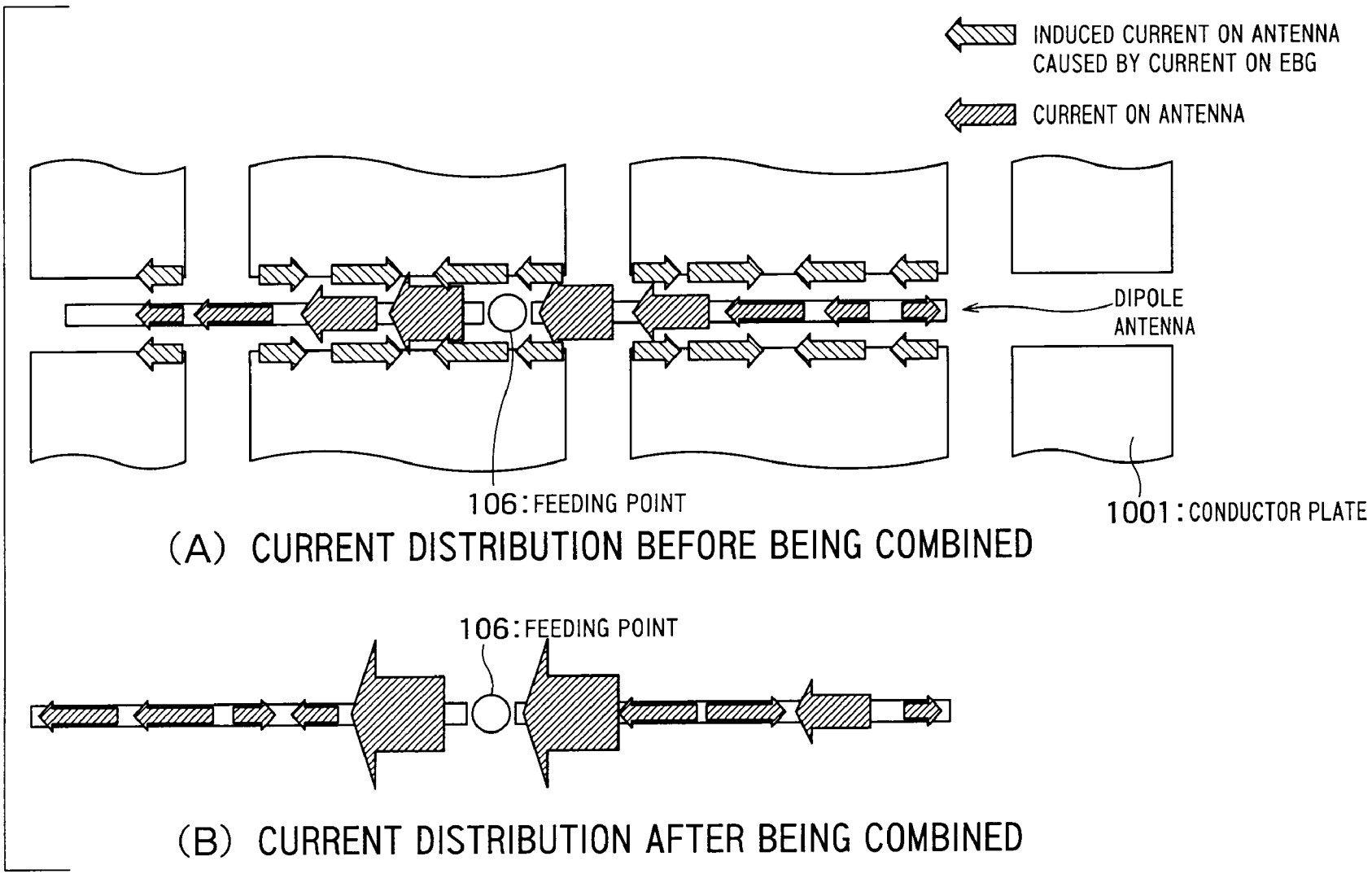
FIG. 4 illustrates current distribution on the dipole antenna of FIG. 3.

FIG. 4 illustrates current distribution on the dipole antenna of FIG. 3. FIG. 4(A) separately illustrates an induced current that is generated on the dipole antenna due to the current generated on the EBG substrate and a current that originally exists on the dipole antenna. FIG. 4(B) shows a combined current as the sum of those currents (i.e., a current that actually flows on the dipole antenna).

As will be understood from comparison with the example of FIG. 2 (the first embodiment), in the example of FIG. 4, the difference between the combined current on the linear conductive elements 102, 103 and the current that originally exists on the linear conductive elements 102 and 103 is still smaller in the vicinity of the feeding point 106 than in the first embodiment.

In the first embodiment, change of current at the feeding point itself is small but change of current distribution around the feeding point is larger than in the second embodiment. Thus, unnecessary current leakage is more likely to flow in a feeder line 105 than in the second embodiment. On the other hand, in the second embodiment, although change of current distribution around the feeding point is small, more change of current at the feeding point itself occurs than in the first embodiment. It is accordingly desirable to apply the first and second embodiments as appropriate for specifications.

Third Embodiment

Figure 5:
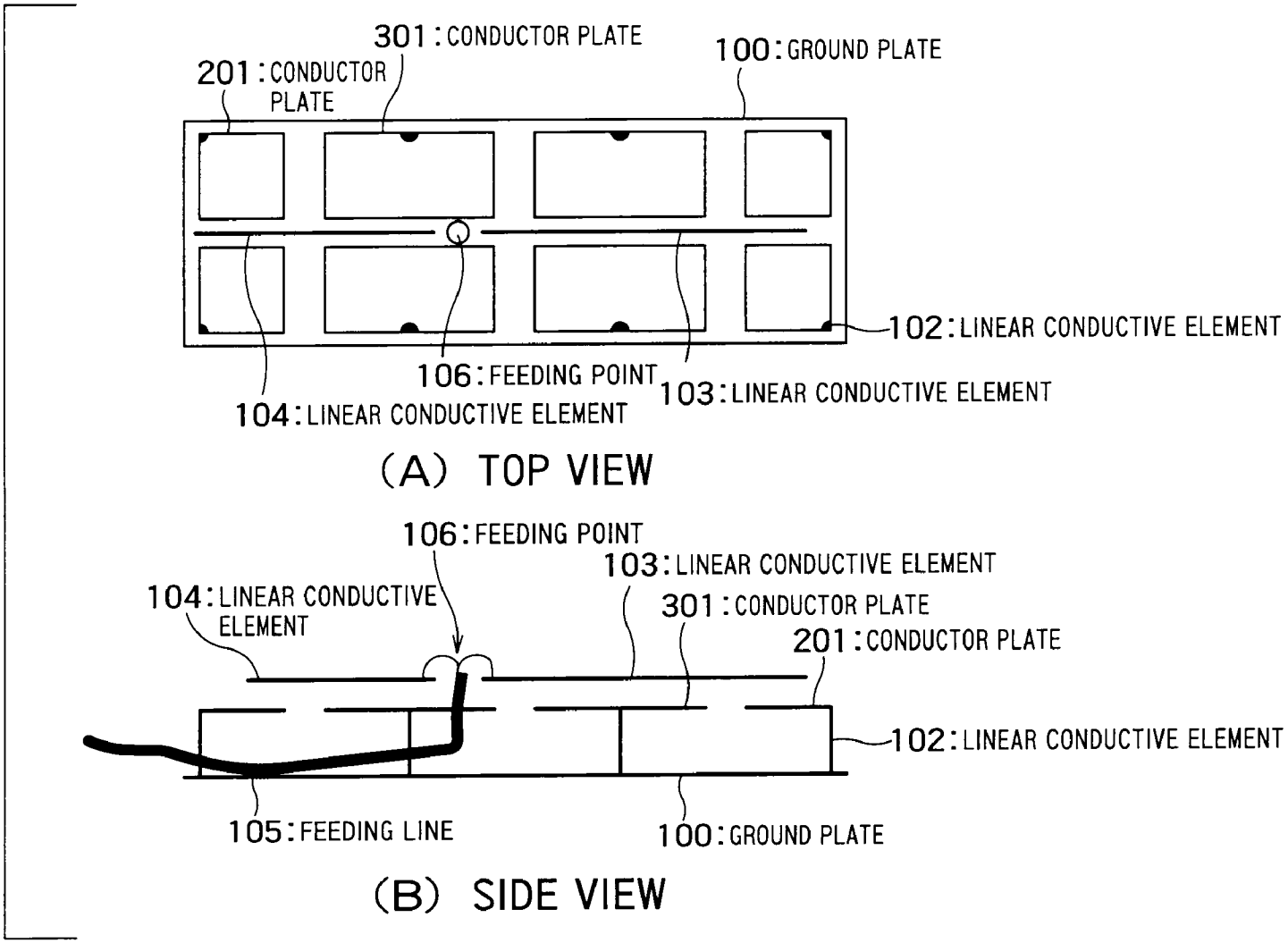
FIG. 5 shows a configuration of an antenna apparatus as a third embodiment of the present invention.

FIG. 5 shows a configuration of an antenna apparatus as a third embodiment of the present invention. FIG. 5(A) is a top view and 5(B) is a side view of the antenna apparatus.

In this embodiment, any side of each conductor plate that has no neighboring conductor plate is trimmed in half. Therefore, in the illustrated example, among conductor plates arranged in a matrix, the size of a conductor plate 201 which is positioned at a corner of the matrix is one fourth of the original size and that of other conductor plates 301 is half the original size. The EBG substrate operates by parallel resonance caused by capacitance generated in gaps between conductor plates, the linear conductive element 102 which shorts the capacitance, and inductance of the conductor plates (201 and 301), providing high impedance characteristics. Therefore, in one conductor plate in its entirety, a portion that has no neighboring conductor plate from the viewpoint of the linear conductive element 102 does not contribute to operation. In view of this fact, this embodiment trims a portion of a conductor plate that does not contribute to operation to reduce the size of the ground plate 100 and hence that of the entire antenna apparatus.

The present invention described above with respect to its embodiments can be also applied to wireless communication typified by wireless terminals such as mobile phones or PCs utilizing a wireless LAN, antennas for receiving terrestrial digital broadcasting, or other antennas for radar and the like. It is especially suitable for an antenna that is mounted on a surface of a mobile object which requires reduction of thickness.

The present invention is not limited to the exact embodiments described above and can be embodied with its components modified in an implementation phase without departing from the scope of the invention. Also, arbitrary combinations of the components disclosed in the above-described embodiments can form various inventions. For example, some of the all components shown in the embodiments may be omitted. Furthermore, components from different embodiments may be combined as appropriate.

What is claimed is:

1. An antenna apparatus, comprising:

a finite ground plate;

a plurality of conductor plates arranged along and on both sides of each of a first gap line and a second gap line which intersects with the first gap line;

a plurality of first linear conductive elements configured to connect the finite ground plate with each of the conductor plates; and an antenna element configured to have second and third linear conductive elements arranged in the first gap line and a feeding point that is placed between adjacent ends of the second and third linear conductive elements for supplying electric power from the ends, wherein the feeding point is positioned in an intersection area of the first gap line and the second gap line and off a center line of the second gap line.

2. The apparatus according to claim 1, wherein a length of each side of the conductor plate is approximately λ/4 when a wavelength used is "λ".

3. The apparatus according to claim 1, wherein the conductor plates are arranged in a matrix, and ones of the conductor plates that are positioned outermost are connected at a peripheral portion thereof with the finite ground plate via the first linear conductive element.

4. The apparatus according to claim 1, wherein a length of the antenna element is approximately half a wavelength used.

5. An antenna apparatus, comprising:

a finite ground plate;

a plurality of conductor plates arranged along and on both sides of each of a first gap line and a second gap line which intersects with the first gap line;

a plurality of first linear conductive elements configured to connect the finite ground plate with each of the conductor plates; and an antenna element configured to have second and third linear conductive elements arranged in the first gap line and a feeding point that is placed between adjacent ends of the second and third linear conductive elements for supplying electric power from the ends, wherein the feeding point is placed separately from a center line of the second gap line by a distance "L" along the first gap line, where "L" is a positive number equal to or smaller than one fourth of the length of each side of the conductor plate.

6. The apparatus according to claim 5, wherein the length of each side of the conductor plate is approximately $\lambda/4$ when a wavelength used is "$\lambda$".

7. The apparatus according to claim 5, wherein the conductor plates are arranged in a matrix, and ones of the conductor plates that are positioned outermost are connected at a peripheral portion thereof with the finite ground plate via the first linear conductive element.

8. The apparatus according to claim 5, wherein the length of the antenna element is approximately half a wavelength used.

* * * * *